United States Patent [19]

Orter

[11] 4,427,016

[45] Jan. 24, 1984

[54] COMBINATION ASH-TRAY

[76] Inventor: Ralph H. Orter, P.O. Box 2074, Prescott, Ariz. 86302

[21] Appl. No.: 164,061

[22] Filed: Jun. 30, 1980

[51] Int. Cl.[3] ..... A24F 19/00

[52] U.S. Cl. ..... 131/238; 131/240 R; 131/241

[58] Field of Search ..... 131/238, 239, 231, 237, 131/240 R, 240 E

[56] References Cited

U.S. PATENT DOCUMENTS

| | | | |
|---|---|---|---|
| 1,663,601 | 3/1928 | Kappenberg | 131/238 X |
| 1,988,760 | 1/1935 | Thomas | 131/242 X |
| 2,002,494 | 5/1935 | Eisenberg | 131/241 |
| 2,973,766 | 3/1961 | Milbourne | 131/241 X |

*Primary Examiner*—Stephen C. Pellegrino

[57] ABSTRACT

The present invention consists of an ashtray with a three sided upright portion with pairs of slide-in grooves to display advertising cards which extend above the top for removing and turning to view opposite slides, said three sided portion including a front center upright semi-circular flue with an attaching bracket at its lower end at holding means at the upper end thereof; the ashtray further including a semi-circular tray with engaging pins which couple onto said attaching bracket, said tray in a horizontal position supports a cigarette and when rotated upward, with a lighted end down cigarette thereon, engages said flue to produce a rounded flue, wherein an updraft through said flue sustains a cigarette in a lighted condition.

1 Claim, 2 Drawing Figures

COMBINATION ASH-TRAY

This invention relates to a ash-tray possessing a three sided upright portion that is provided with pairs of upright slide-in grooves on two sides to accomodate advertising material. The ash tray is provided with half circle upright flue, positioned in front center, said flue possesses an attaching bracket portion, positioned on front of said flue and ash-tray, and is provided with a half circled tray member that couples on to said attaching bracket portion to function as a cigarette holder. The tray member will also rotate upward to engage with said flue to form a rounded chimney.

Figure 1:
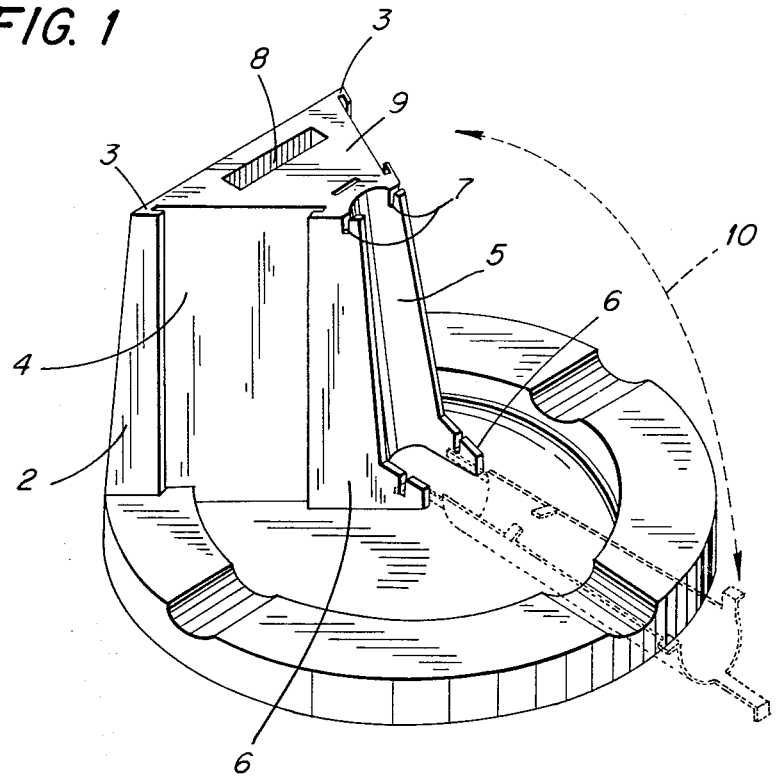

Drawing in FIG. 1 shows a ash-tray with a three sided upright portion with upright slide-in grooves and a upright half circle flue that possesses a attaching bracket portion positioned on front of said flue.

Figure 2:
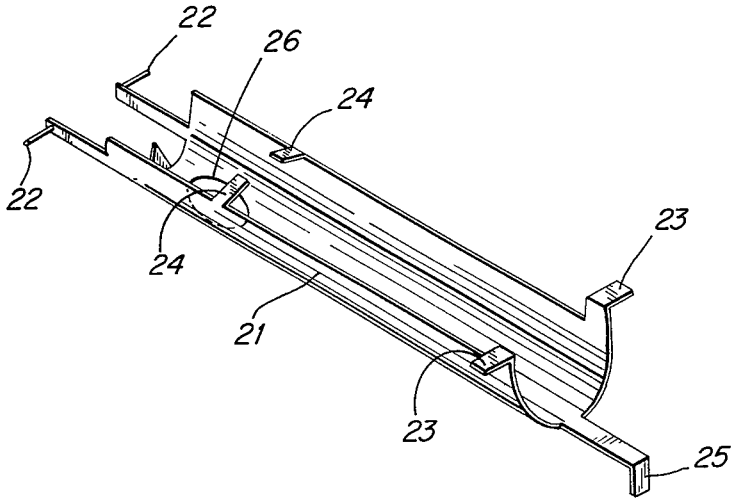

FIG. 2 shows a half circled tray member with front engagers that couple onto said attaching bracket portion to lay horizontally or rotate upward to engage with said flue.

NUMBERING ON DRAWINGS

No.-1 refers to ash-tray
No.-2 refers to three sided upright portion
No.-3 refers to slide-in grooves
No.(4) refers to advertising material
No.-5 refers to upright flue
No.-6 refers to attaching bracket portion on flue
No.-7 refers to holding depression
No.-8 refers to book match depression
No.-9 refers to additional holding depression
No.-10 refers to upward path of rotation
No.-21 refers to tray member in FIG. 2
No.-22 refers to tray member engagers or pins
No.-23 refers to holding prongs
No.-24 refers to cigarette holders
No.-25 refers to handle
No.-26 refers to an opening in the tray member In a Combination Ash-tray as defined herein that consists of: a ash-tray 1 possessing a three sided upright portion 2 provided with pairs of upright slide-in grooves 3 on two sides to accomodate advertising material (4). Said three sided upright portion is provided with an upright half circle flue 5, positioned in front center, that is provided with attaching bracket portions 6 positioned directly on the lower front portion of said flue. The ash-tray is provided with a half circled tray member 21, as shown in FIG. 2, drawing having front pins or engagers 22 which couple onto said attaching bracket portion 6 in a horizontal position whereon a cigarette may be disposed. When desired, the tray member with a lighted end down cigarette thereon, may be rotated upward as shown in circular path 10, to engage with said flue holding depressions 7, to produce a rounded flue or chimney. An updraft through the opening 26 and rounded flue will sustain a cigarette in a lighted condition until removed by the user.

I claim:

1. An ashtray having a three sided portion extending upright therefrom, two sides of said upright portion having pairs of slide-in grooves to accomodate advertising material and the third side of said upright portion including a semi-circular flue means extending the length thereof and positioned above the center of the ashtray, said flue means including attaching bracket means at the lower end of thereof and holding means at the upper end of said flue means; a semi-circular tray means having pin means pivotally attached to said to said bracket means, and prong means at the opposite end of the said tray means for securement with said holding means; said tray means further including an opening in the lower end thereof and prong means to prevent cigarette slide-down; whereby said tray means may be rotated to a horizontal position relative to the ashtray for holding a lighted cigarette, or positioned in a vertical position to be engaged with said semi-circular flue means to hold a lighted cigarette with its lit end downward; the opening in said tray means creating an up draft which sustains the cigarette in a lighted condition.

* * * * *